US005538090A

United States Patent [19]

Siler

[11] Patent Number: 5,538,090

[45] Date of Patent: Jul. 23, 1996

[54] GROUND PROBE APPARATUS

[76] Inventor: Gary W. Siler, Rte. 1, Box 223-K, Interlachen, Fla. 32148

[21] Appl. No.: 419,732

[22] Filed: Apr. 10, 1995

[51] Int. Cl.[6] ..... E21B 7/26; E21B 17/00

[52] U.S. Cl. ..... 175/19; 175/325.2; 175/325.5

[58] Field of Search ..... 175/19, 20, 21, 175/22, 314, 320, 325.5, 325.6, 325.7, 325.2

[56] References Cited

U.S. PATENT DOCUMENTS

| | | | |
|---|---|---|---|
| 4,372 | 5/1871 | Green | 175/314 X |
| 64,192 | 4/1867 | Budd | 175/22 |
| 65,648 | 6/1867 | Craig | 175/22 X |
| 76,485 | 4/1868 | Martin | 175/22 |
| 982,023 | 1/1911 | Sands | 175/19 |
| 1,489,916 | 4/1924 | Blamphin | 175/20 |
| 2,472,120 | 6/1949 | Murphy | 175/22 |
| 4,624,194 | 11/1986 | Zinck | 111/7.2 |
| 5,150,622 | 9/1992 | Vollweiler | 73/864.64 |
| 5,186,263 | 2/1993 | Kejr et al. | 175/20 |
| 5,209,129 | 5/1993 | Jaselskis et al. | 73/864.64 |
| 5,279,153 | 1/1994 | Dussan V. et al. | 73/155 |

*Primary Examiner*—Stephen J. Novosad

[57] ABSTRACT

A ground probe apparatus includes a rod portion which includes a rod outer diameter. A handle portion is connected to a proximal end of the rod portion. A ground-penetrating tip portion is connected to a distal end of the rod portion. The ground,penetrating tip portion includes a tip end, and a wide-diameter portion is connected to the rod portion a predetermined distance from the tip end of the ground-penetrating tip portion. The wide-diameter portion has a wide-portion outer diameter which is greater than the rod outer diameter. The wide-diameter portion and the ground-penetrating tip portion may be combined into an integrated, unitary wide-diameter, tip assembly which can be selectively removed from and replaced on the rod portion. The wide-diameter portion includes a first tapered portion tapering toward the tip end and a second tapered portion tapering away from the tip end. The wide-diameter portion may be in a form of a wide-diameter sleeve that fits onto the rod portion the predetermined distance from the tip end of the ground-penetrating tip portion. The rod portion may include a first rod segment, a second rod segment, and a coupler segment connected between the first rod segment and the second rod segment. By not using either the first rod segment or the second rod segment and the coupler segment, the length of the rod portion can be shortened.

6 Claims, 3 Drawing Sheets

GROUND PROBE APPARATUS

BACKGROUND OF THE INVENTION

1. Field of the Invention

The present invention relates generally to ground-penetrating devices and, more particularly, to manually operated devices especially adapted for probing the ground.

2. Description of the Prior Art

There are a number of endeavors in which probing the ground for buried objects is an important activity. For examples, plumbers often probe the ground for buried pipes. Utility workers and sewage maintenance workers often probe the ground to locate existing septic tanks and drain fields. Treasure hunters often probe the ground to locate buried relics. Also, bottle collectors often probe the ground to locate buried bottles.

A typical manually operated ground probe has a tapered tip that is tapered in one direction. The direction of taper is toward a distal point. A ground probe having such a unidirectionally tapered tip requires a great deal of pressure and continuous effort to push into the ground. In this respect, it would be desirable if a ground probe were provided which does not require a great deal of pressure and continuous effort to push into the ground.

Throughout the years, a number of innovations have been developed relating to unidirectionally tapered ground probes, and the following U.S. Pat. Nos. are representative of some of those innovations: 4,624,194; 5,150,622; 5,186,263; 5,209,129; and 5,279,153. It is noted that none of the prior art devices provide a convenient way to replace a ground-penetrating tip that has become worn or damaged. Moreover, none of the prior art devices provides a way to select specific ground-penetrating tip from a variety of possible alternative ground-penetrating tips. In this respect, it would be desirable if a ground probe provided a way to replace a ground-penetrating tip.

It has been common practice for a number of years among treasure hunters to have a bead welded a predetermined distance (approximately two inches) from the ground-penetrating tip of the ground-penetrating rod. The bead has an outer diameter which is greater than the outer diameter of the ground-penetrating rod. The presence of the bead helps reduce friction between the ground-penetrating rod and the surrounding ground. Not only is the welded bead technique quite expensive, but the welded bead often falls off after a short period of time. In this respect, it would be desirable if a ground probe were provided which includes a wide-diameter, ground-penetrating portion along the ground-penetrating rod which is located a predetermined distance from the ground-penetrating tip of the probe.

A ground-penetrating probe which has a unidirectionally tapered tip provides wedging action for penetrating the ground. However, it has been discovered that a wedging action is also desirable when a tip that has already been pushed into the ground is to be removed from the ground. In this respect, it would be desirable if a ground probe were provided with a first wedging action for penetrating the ground and a second wedging action for removing the tip from the ground.

Depending upon circumstances, at times, it may be desirable to employ a relatively long ground-penetrating rod portion of a ground probe apparatus. At other times, it may be desirable to employ a relatively short ground-penetrating rod portion. In this respect, it would be desirable if a ground probe were provided which included a ground-penetrating rod portion that has an adjustable length.

Thus, while the foregoing body of prior art indicates it to be well known to use ground probe devices, the prior art described above does not teach or suggest a ground probe apparatus which has the following combination of desirable features: (1) does not require a great deal of pressure and continuous effort to push into the ground; (2) provides a way to replace a ground-penetrating tip; (3) includes a wide-diameter, ground-penetrating portion along the ground-penetrating rod which is located a predetermined distance from the ground-penetrating tip of the probe; (4) provides a first wedging action for penetrating the ground and a second wedging action for removing the tip from the ground; and (5) includes a ground-penetrating rod portion that has an adjustable length. The foregoing desired characteristics are provided by the unique ground probe apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a ground probe apparatus which includes a rod portion which includes a proximal end and a distal end and which has a rod outer diameter. A handle portion is connected to the proximal end of the rod portion. A ground-penetrating tip portion is connected to the distal end of the rod portion. The ground-penetrating tip portion includes a tip end, and a wide-diameter portion is connected to the rod portion a predetermined distance from the tip end of the ground-penetrating tip portion. The wide-diameter portion has a wide-portion outer diameter which is greater than the rod outer diameter.

The wide-diameter portion and the ground-penetrating tip portion may be combined into an integrated, unitary wide-diameter, tip assembly. The wide-diameter, tip assembly includes internal threads, and the distal end of the rod portion includes complementary external threads. The wide-diameter portion includes a first tapered portion tapering toward the tip end and a second tapered portion tapering away from the tip end.

The handle portion is T-shaped with a connector portion for the rod portion located at a mid-point between lateral ends of the handle portion.

The wide-diameter portion may be in a form of a wide-diameter sleeve that fits onto the rod portion the predetermined distance from the tip end of the ground-penetrating tip portion.

The rod portion may include a first rod segment for connecting to the handle portion, a second rod segment for connecting to the ground-penetrating tip portion, and a coupler segment connected between the first rod segment and the second rod segment. The first rod segment includes external threads. The second rod segment includes external threads. The coupler segment includes first internal threads for connecting with the external threads of the first rod segment, and the coupler segment includes second internal threads for connecting with the external threads of the second rod segment.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ground probe apparatus which has all of the advantages of the prior art and none of the disadvantages.

It is another object of the present invention to provide a new and improved ground probe apparatus which may be easily and efficiently manufactured and marketed.

It is a further object of the present invention to provide a new and improved ground probe apparatus which is of durable and reliable construction.

An even further object of the present invention is to provide a new and improved ground probe apparatus which is susceptible of a low cost of manufacture with regard to both materials and labor, and which accordingly is then susceptible of low prices of sale to the consuming public, thereby making such ground probe apparatus available to the buying public.

Still yet a further object of the present invention is to provide a new and improved ground probe apparatus which does not require a great deal of pressure and continuous effort to push into the ground.

Still another object of the present invention is to provide a new and improved ground probe apparatus that provides a way to replace a ground-penetrating tip.

Yet another object of the present invention is to provide a new and improved ground probe apparatus which includes a wide-diameter, ground-penetrating portion along the ground-penetrating rod which is located a predetermined distance from the ground-penetrating tip of the probe.

Even another object of the present invention is to provide a new and improved ground probe apparatus that provides a first wedging action for penetrating the ground and a second wedging action for removing the tip from the ground.

Still a further object of the present invention is to provide a new and improved ground probe apparatus which includes a ground-penetrating rod portion that has an adjustable length.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved ground probe apparatus embodying the principles and concepts of the present invention will be described.

Figure 1:
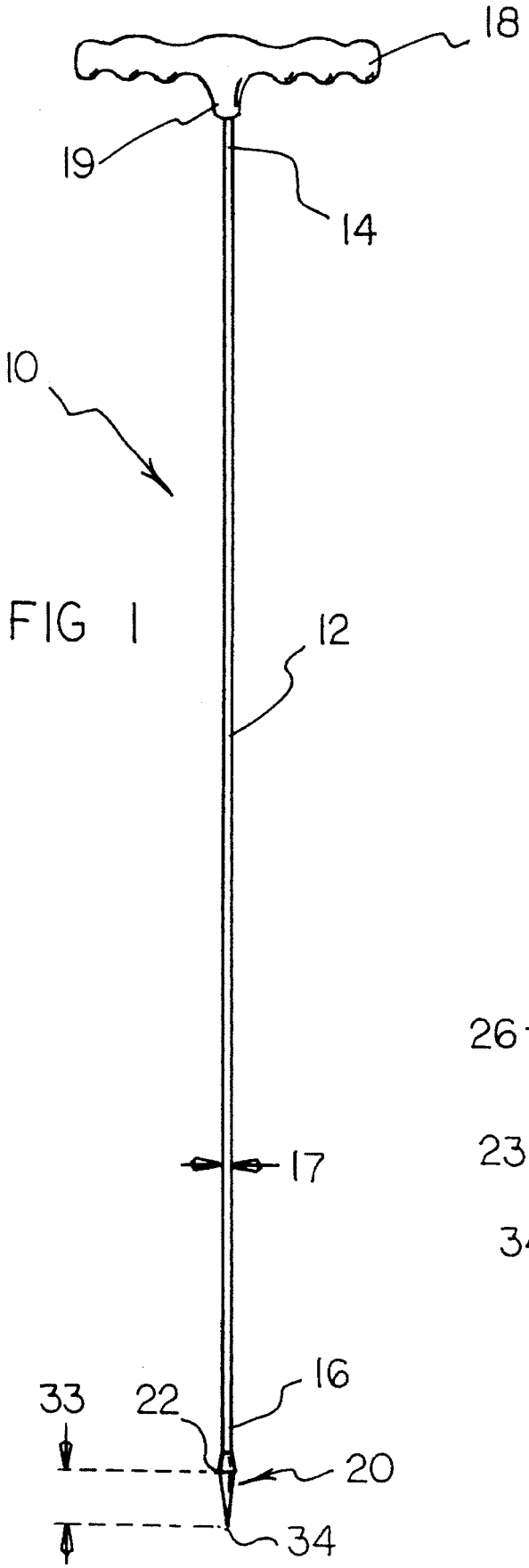
FIG. 1 is a front view showing a first embodiment of the ground probe apparatus of the invention which has a solid removable and replaceable ground-penetrating tip.
Figure 2:
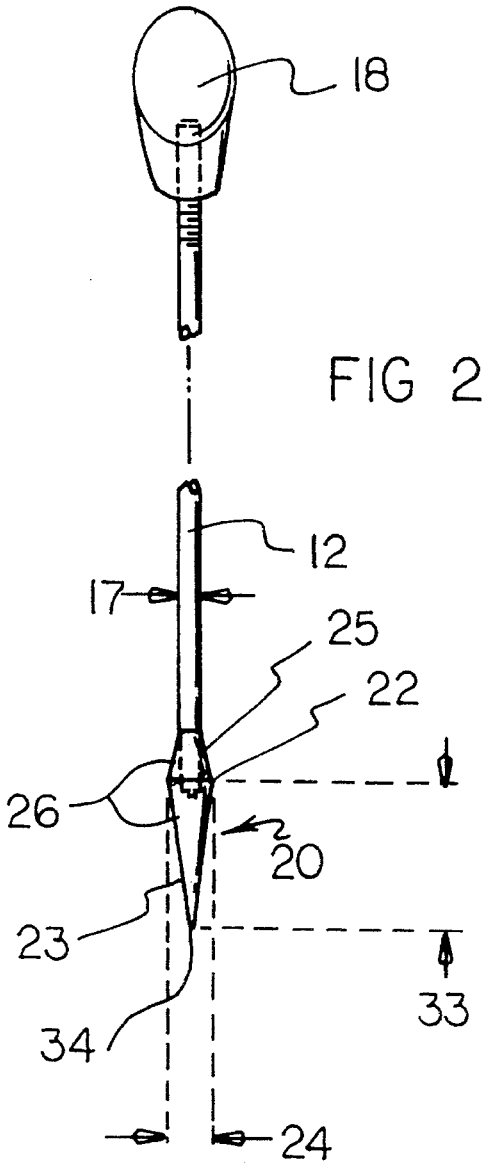
FIG. 2 is a side view, partially compressed, of the embodiment of the ground probe apparatus shown in FIG. 1.

Turning to FIGS. 1 and 2, there is shown a first embodiment of the ground probe apparatus of the invention generally designated by reference numeral 10. In this form, the ground probe apparatus 10 includes a rod portion 12 which includes a proximal end 14 and a distal end 16 and which has a rod outer diameter 17. A handle portion 18 is connected to the proximal end 14 of the rod portion 12. A ground-penetrating tip portion 20 is connected to the distal end 16 of the rod portion 12. The ground-penetrating tip portion 20 includes a tip end 34, and a wide-diameter portion 22 is connected to the rod portion 12 a predetermined distance 33 from the tip end 34 of the ground-penetrating tip portion 20. The wide-diameter portion 22 has a wide-portion outer diameter 24 which is greater than the rod outer diameter 17.

The wide-diameter portion 22 and the ground-penetrating tip portion 20 may be combined into an integrated, unitary wide-diameter, tip assembly 26. The wide-diameter, tip assembly 26 includes internal threads 28, and the distal end 16 of the rod portion 12 includes complementary external threads 30. The wide-diameter portion 22 includes a first tapered portion 23 tapering toward the tip end 34 and a second tapered portion 25 tapering away from the tip end 34.

The handle portion 18 is T-shaped with a connector portion for the rod portion 12 located at a mid-point 19 between lateral ends of the handle portion 18. The T-shaped handle portion 18 permits two hands of a person to be used simultaneously when the ground probe apparatus of the invention is employed. As shown in the drawings, the handle portion 18 can fit onto the rod portion 12 using complementary threaded portions.

In using the embodiment of the invention shown in FIGS. 1 and 2, the wide-diameter, tip assembly 26 is selectively screwed onto or screwed off of the distal end 16 of the rod portion 12.

Figure 3:
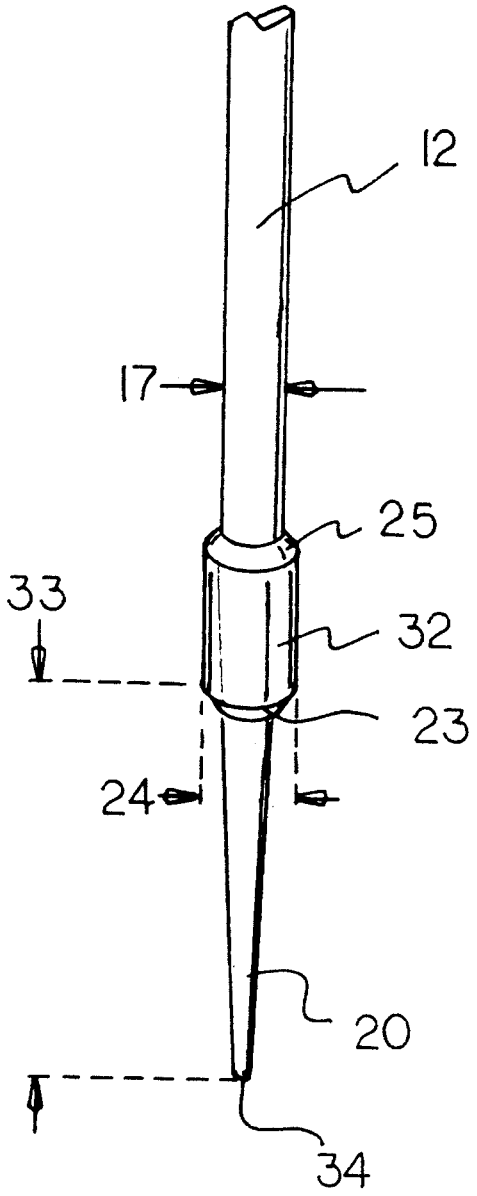
FIG. 3 is a partial perspective view of a second embodiment of the ground probe apparatus of the invention which has a removable and replaceable wide-diameter sleeve that is placed along the ground-penetrating rod a predetermined distance from the ground-penetrating tip.
Figure 4:
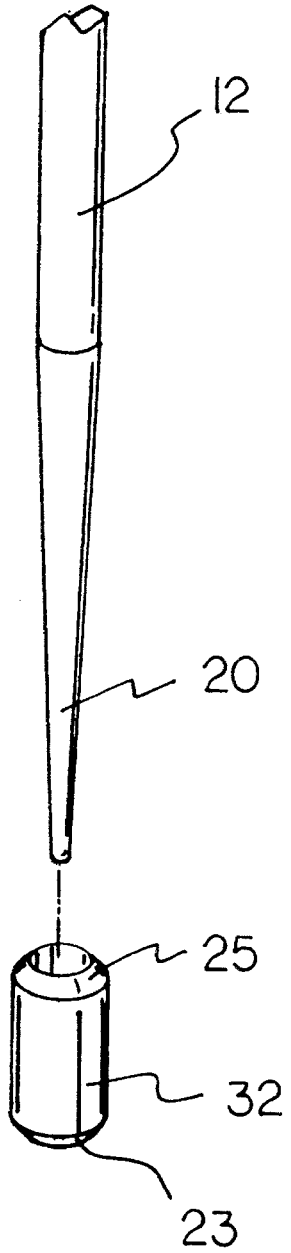
FIG. 4 is a partially exploded view of the embodiment of the invention shown in FIG. 3.

Turning to FIGS. 3 and 4, a second embodiment of the invention is shown. Reference numerals are shown that correspond to like reference numerals that designate like elements shown in the other figures. In addition, the wide-diameter portion is in a form of a wide-diameter sleeve 32 that fits onto the rod portion 12 the predetermined distance 33 from the tip end 34 of the ground-penetrating tip portion 20. The wide-diameter sleeve 32 can fit onto the rod portion 12 in a number of ways. For example, the wide-diameter sleeve 32 can fit on the rod portion 12 with a friction fit. Alternatively, the wide-diameter sleeve 32 can fit on the rod portion 12 with a screw fit, that is, the wide-diameter sleeve 32 can have internal threads, and the rod portion 12 can have complementary external threads. The wide-diameter sleeve 32 also includes a first tapered portion 23 and a second tapered portion 25.

Figure 5:
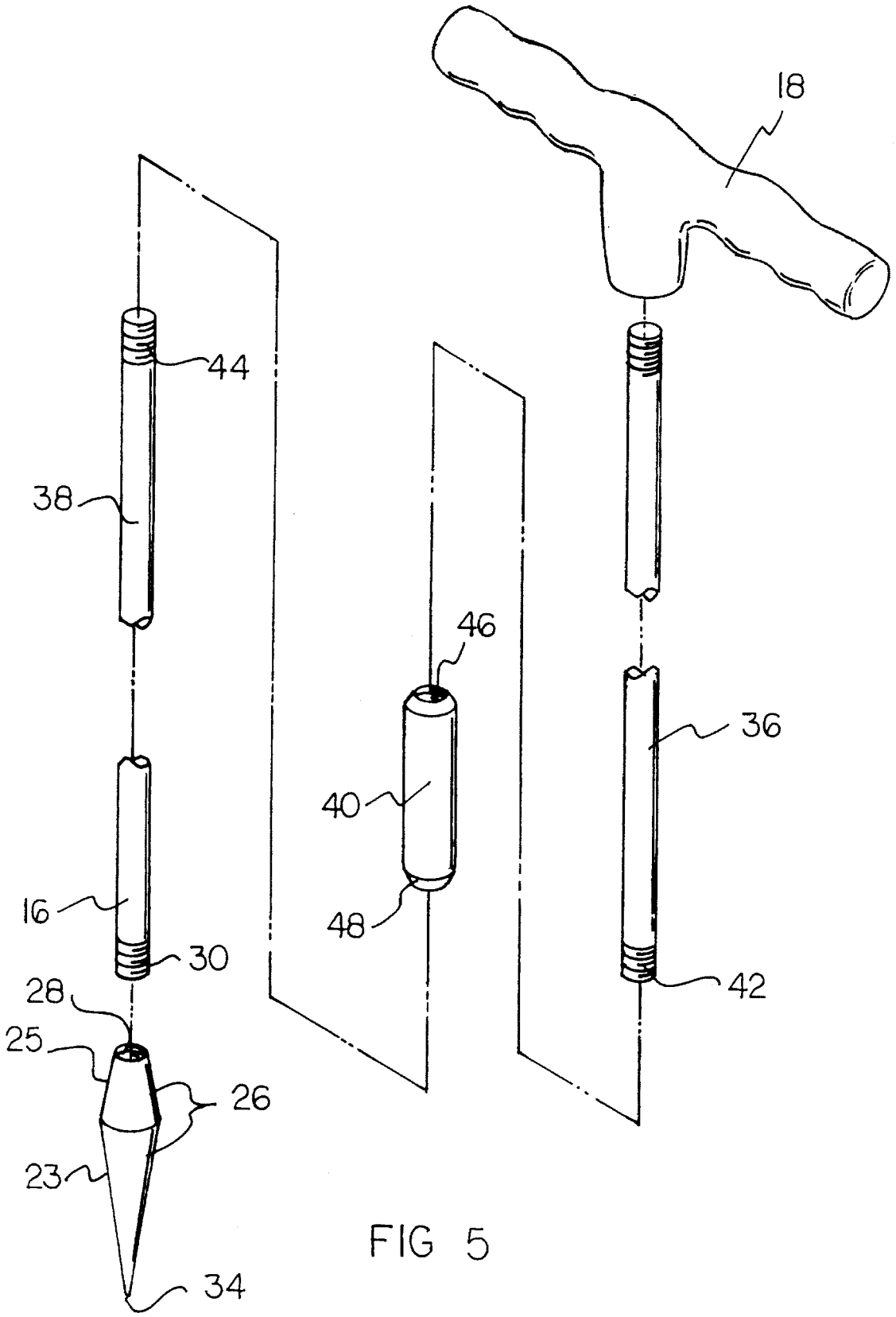
FIG. 5 is an exploded perspective view of a third embodiment of the invention which an adjustable length ground-penetrating rod.

Turning to FIG. 5, a third embodiment of the invention is shown. Reference numerals are shown that correspond to like reference numerals that designate like elements shown in the other figures. In addition, the rod portion 12 includes a first rod segment 36 for connecting to the handle portion 18, a second rod segment 38 for connecting to the ground-penetrating tip portion 20, and a coupler segment 40 is connected between the first rod segment 36 and the second rod segment 38. The first rod segment 36 includes external threads 42. The second rod segment 38 includes external threads 44. The coupler segment 40 includes first internal threads 46 for connecting with the external threads 42 of the first rod segment 36, and the coupler segment 40 includes second internal threads 48 for connecting with the external threads 44 of the second rod segment 38.

When the ground probe apparatus of the invention is to have a relatively long rod portion 12, the first rod segment 36, the coupler segment 40, and the second rod segment 38 are employed. However, if the rod portion 12 is to be shorter in length, either the first rod segment 36 and the coupler segment 40 or the second rod segment 38 and the coupler segment 40 are removed. If desired, the ground-penetrating tip portion 20 can be solid, or, alternatively, the ground-penetrating tip portion 20 can be hollow.

The components of the ground probe apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved ground probe apparatus that is low in cost, relatively simple in design and operation, and which does not require a great deal of pressure and continuous effort to push into the ground. With the invention, a ground probe apparatus provides a way to replace a ground-penetrating tip. With the invention, a ground probe apparatus is provided which includes a wide-diameter, ground-penetrating portion along the ground-penetrating rod which is located a predetermined distance from the ground-penetrating tip of the probe. With the invention, a ground probe apparatus provides a first wedging action for penetrating the ground and a second wedging action for removing the tip from the ground. With the invention, a ground probe apparatus is provided which includes a ground-penetrating rod portion that has an adjustable length.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A ground probe apparatus, comprising:

a rod portion which includes a proximal end and a distal end which has a rod outer diameter, a handle portion connected to said proximal end of said rod portion, a ground-penetrating tip portion connected to said distal end of said rod portion, wherein said ground-penetrating tip portion includes a tip end, and a wide-diameter portion located adjacent to said ground-penetrating tip portion and connected to said rod portion a predetermined distance from said tip end of said ground-penetrating tip portion, wherein said wide-diameter portion has a wide-portion outer diameter which is greater than said rod outer diameter, wherein said wide-diameter portion includes a first tapered portion tapering toward said tip end, and a second tapered portion tapering away from said tip end, wherein said first tapered portion and said second tapered portion are juxtaposed back to back, wherein said rod portion includes a first rod segment for connecting to said handle portion, a second rod segment for connecting to said ground-penetrating tip portion, and a coupler segment connected between said first rod segment and said second rod segment.

2. The apparatus of claim 1 wherein said wide-diameter portion and said ground-penetrating tip portion are combined into an integrated, unitary wide-diameter, tip assembly.

3. The apparatus of claim 2 wherein:

said wide-diameter, tip assembly includes internal threads, and said distal end of said rod portion includes complementary external threads.

4. The apparatus of claim 1 wherein said handle portion is T-shaped with a connector portion for said rod portion located at a mid-point between lateral ends of said handle portion.

5. The apparatus of claim 1 wherein:

said first rod segment includes external threads, said second rod segment includes external threads, said coupler segment includes first internal threads for connecting with said external threads of said first rod segment, and said coupler segment includes second internal threads for connecting with said external threads of said second rod segment.

6. A ground probe apparatus, comprising:

a rod portion which includes a proximal end and a distal end and which has a rod outer diameter, a handle portion connected to said proximal end of said rod portion, a ground-penetrating tip portion connected to said distal end of said rod portion, wherein said ground-penetrating tip portion includes a tip end, and a wide-diameter portion located adjacent to said ground-penetrating tip portion and connected to said rod portion a predetermined distance from said tip end of said ground-penetrating tip portion, wherein said wide-diameter portion has a wide-portion outer diameter which is greater than said rod outer diameter, wherein said wide-diameter portion is in a form of a wide-diameter sleeve that fits onto said rod portion said predetermined distance from said tip end of said ground-penetrating tip portion.

* * * * *